US007034251B1

(12) United States Patent
Child et al.

(10) Patent No.: US 7,034,251 B1
(45) Date of Patent: Apr. 25, 2006

(54) WARMING BLANKET

(75) Inventors: Andrew D. Child, Moore, SC (US); Karen M. Green, Simpsonville, SC (US); Alfred R. DeAngelis, Spartanburg, SC (US); David B. Wilson, Spartanburg, SC (US); Shawn Davis, Inman, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 11/131,822

(22) Filed: May 18, 2005

(51) Int. Cl.
*H05B 1/00* (2006.01)

(52) U.S. Cl. ..... 219/212; 219/545; 219/528; 219/529; 219/549

(58) Field of Classification Search ..... 219/211–12, 219/545, 528, 516, 529, 543, 544, 549
See application file for complete search history.

(56) References Cited

U.S. PATENT DOCUMENTS

| | | | | |
|---|---|---|---|---|
| 4,031,352 | A | 6/1977 | Oosterberg | 219/212 |
| 4,058,704 | A | 11/1977 | Shimizu | 219/528 |
| 4,061,827 | A | 12/1977 | Gould | 428/368 |
| 4,198,562 | A | 4/1980 | Mills et al. | 219/505 |
| 4,485,296 | A | 11/1984 | Ueda et al. | 219/505 |
| 4,577,094 | A | 3/1986 | Mills | 219/505 |
| 4,598,195 | A | 7/1986 | Matsuo | 219/497 |
| 4,607,154 | A | 8/1986 | Mills | 219/505 |
| 4,633,062 | A | 12/1986 | Nishida et al. | 219/212 |
| 4,656,334 | A | 4/1987 | Endo et al. | 219/212 |
| 4,677,281 | A | 6/1987 | Mills | 219/505 |
| 4,855,572 | A | 8/1989 | Wallgren et al. | 219/444.1 |
| 5,422,462 | A | 6/1995 | Kishimoto | 219/545 |
| 5,484,983 | A | 1/1996 | Roell | 219/545 |
| 5,581,192 | A | 12/1996 | Shea et al. | 324/722 |
| 5,776,609 | A | 7/1998 | McCullough | 428/375 |
| 5,804,291 | A | 9/1998 | Fraser, Jr. | 428/283 |
| 5,824,996 | A | 10/1998 | Kochman et al. | 219/529 |
| 5,837,164 | A | 11/1998 | Zhao | 252/500 |
| 5,861,610 | A | 1/1999 | Weiss | 219/497 |
| 5,902,518 | A | 5/1999 | Khazai et al. | 252/511 |
| 5,916,506 | A | 6/1999 | Breznak et al. | 264/104 |
| 5,952,099 | A | 9/1999 | Asher et al. | 428/370 |
| 5,968,854 | A | 10/1999 | Akopian et al. | 442/132 |
| 5,972,499 | A | 10/1999 | Rodriguez et al. | 428/368 |
| 6,080,690 | A | 6/2000 | Lebby et al. | 442/209 |
| 6,090,313 | A | 7/2000 | Zhao | 252/500 |
| 6,093,908 | A | 7/2000 | Haag | 219/204 |
| 6,160,246 | A | 12/2000 | Rock et al. | 219/545 |
| 6,172,344 | B1 | 1/2001 | Gordon et al. | 219/529 |
| 6,174,825 | B1 | 1/2001 | Dutt | 442/43 |
| 6,215,111 | B1 | 4/2001 | Rock et al. | 219/545 |
| 6,229,123 | B1 | 5/2001 | Kochman et al. | 219/549 |
| 6,242,094 | B1 | 6/2001 | Breznak et al. | 428/373 |
| 6,288,372 | B1 | 9/2001 | Sandberg et al. | 219/544 |
| 6,310,332 | B1 | 10/2001 | Gerrard | 219/505 |
| 6,381,482 | B1 | 4/2002 | Jayaraman et al. | 600/388 |
| 6,497,951 | B1 | 12/2002 | DeAngelis et al. | 428/364 |

(Continued)

*Primary Examiner*—Shawntina Fuqua
(74) *Attorney, Agent, or Firm*—Terry T. Moyer; Cheryl J. Brickey; Jeffery E. Bacon

(57) ABSTRACT

A warming blanket incorporating an insert layer or sheet with a scrim having one or more pairs of heating and/or sensor wires arranged in a continuous pattern such that pair members are disposed in crossing relation to one another. The pair members may be cut and joined to establish electrical connections at defined crossing points to establish feedback loop circuits with a control element.

19 Claims, 8 Drawing Sheets

U.S. PATENT DOCUMENTS

| | | | | |
|---|---|---|---|---|
| 6,680,117 | B1 | 1/2004 | DeAngelis et al. | 428/372 |
| 6,713,733 | B1 | 3/2004 | Kochman et al. | 219/549 |
| 6,756,572 | B1 | 6/2004 | Lee | 219/505 |
| 6,768,086 | B1 * | 7/2004 | Sullivan et al. | 219/494 |
| 6,770,854 | B1 * | 8/2004 | Keane | 219/529 |
| 2001/0025846 | A1 | 10/2001 | Kochman et al. | 219/545 |
| 2002/0137831 | A1 | 9/2002 | Horibe et al. | 524/439 |
| 2003/0015285 | A1 | 1/2003 | Iwamoto et al. | 156/325 |

* cited by examiner

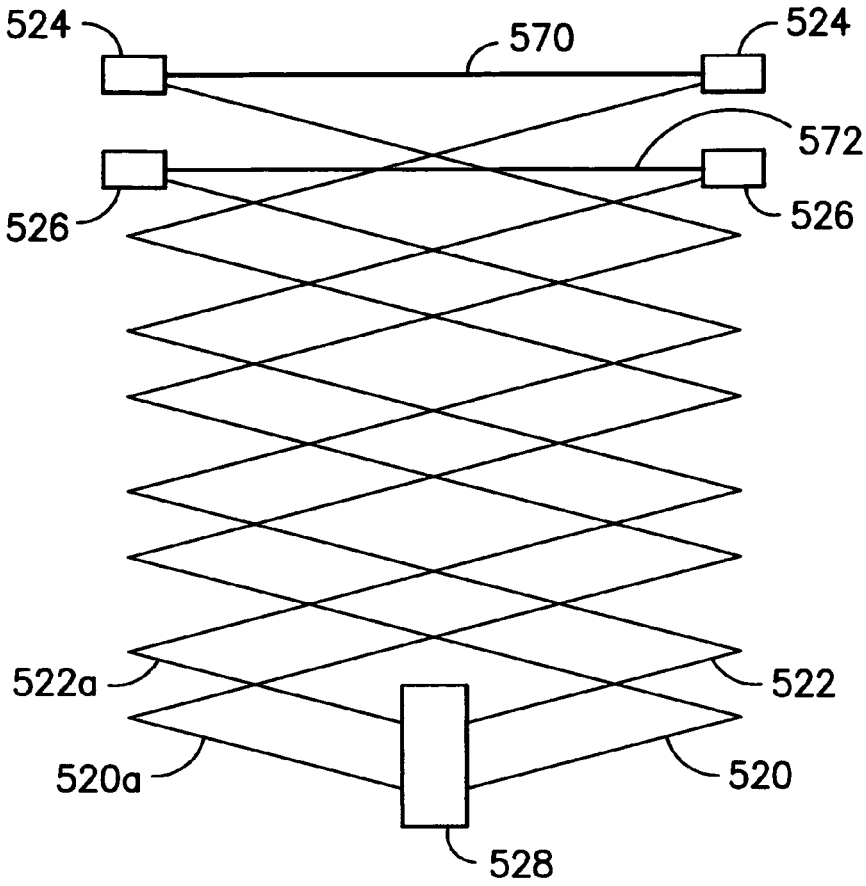
FIG. –8–
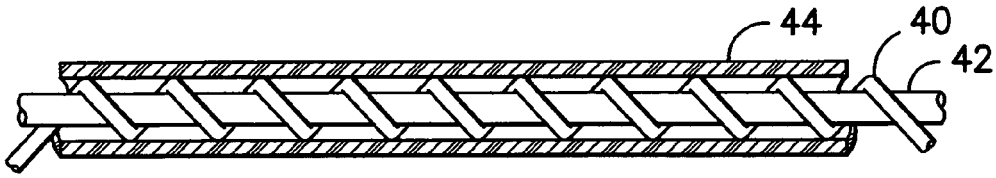
FIG. –9–
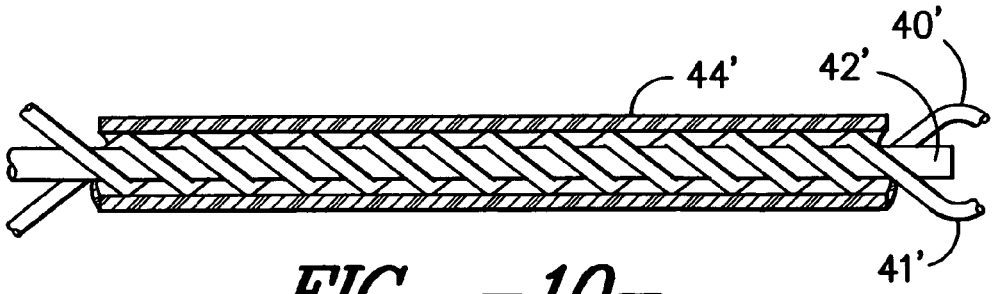
FIG. –10–

WARMING BLANKET

TECHNICAL FIELD

This invention relates generally to warming blankets. More particularly, the invention relates to warming blankets including an arrangement of cooperating pairs of heating and/or sensor elements disposed in a predefined pattern at the interior of the blanket. Methods for forming the blanket and for arranging the heating and sensor elements are also provided. All patent documents referenced in this specification are hereby specifically incorporated by reference in their entirety as if fully set forth herein.

BACKGROUND

Warming blankets incorporating electrically activated heating elements are well known. It is also known to provide warming blankets that incorporate sensor wires in combination with heating elements so as to monitor the level of heat generation. In the construction of warming blankets, it is well known to use wrapped wire constructions in which complementary heating and sensing wires are wrapped around a structural core such as an elongate polymeric fiber or the like. In some prior known constructions, the heating and sensor wires have been disposed within a common insulated covering forming a unitary elongate structure. The elongate structure housing the heating and sensor wires is then threaded in a desired pattern through channels at the interior of the blanket. The wires may be wrapped concentrically with an insulating sleeve between the wires such as disclosed in U.S. Pat. No. 6,153,856 or in a coaxial arrangement such as disclosed in U.S. Pat. No. 5,861,610 to Weiss. It is also known to use double wrapped wires with either a melt down layer or temperature coefficient material between the two wires such as described in U.S. Pat. No. 4,742,212 to Ishii.

In operation of prior heating blanket constructions, an electrical current is passed through the heating and sensor wires causing the heating wire to increase in temperature. The electrical properties of the sensor wire change with temperature in a predetermined manner. Thus, by monitoring the applied current and voltage across the sensor wire, the temperature of the sensor wire can be determined and the current to the heating wire can be increased or decreased so as to raise or lower the temperature of the blanket as desired.

As will be appreciated, in order for a feedback control system to be operable, the sensor wires must be arranged in a complete circuit. In the past, heating and sensor wires have been threaded through interior spaces within the blanket. While such structures may perform well, they may be difficult to manufacture and are not readily susceptible to continuous manufacturing processes.

SUMMARY

The present invention provides advantages and/or alternatives over the known art by providing a warming blanket incorporating an insert layer or sheet structure incorporating a scrim structure having one or more pairs of heating and/or sensor sensor wires arranged such that at least one of the pair members is in a lateral switchback pattern running back and forth laterally across at least a portion of the insert layer. The pair members may be cut and operatively joined to establish a feedback loop circuit with a control element. The insert layer can thus be segmented at any position along its length while still permitting formation of a continuous feedback loop. The present invention thus provides a heating blanket system with an effective and efficient continuous pattern of heating and/or sensing wires that may be formed to virtually any length and with circuit-completing electrical connections between members of complementary pairs of wires at the interior of the blanket.

According to one aspect, it is contemplated that the heating and/or sensor wires may be arranged within the insert layer in a tri-directional angled pattern. In such a pattern, the wires run back and forth along pathways transverse to lateral boundary edges of the insert in angled relation relative to the lateral edges. The cooperating pairs of wires form a recurring pattern of substantially diamond shaped zones along the interior of the insert layer wherein the apex and base of the diamond shaped zones define cross-over points between the pairs. The pair members may be connected in the vicinity of crossing points or by an extended length electrical connector extending between remote positions thereby forming a complete circuit with a control element.

According to another aspect, it is contemplated that complementary pairs of heater and/or sensor wires may be arranged in a substantially bi-directional pattern extending in a straight line substantially parallel relation between lateral edges of the insert. The individual pair members may be arranged to cross one another at the lateral edges where they reverse direction thereby defining connection points to complete the circuit with a control element.

According to another aspect, it is contemplated that a complementary pair of heater and/or sensor wires may be arranged in a side-by-side stacked pattern wherein a first pair member extends back and forth in a switchback pattern extending along one side of the insert layer and a second pair member extends back and forth in a switchback pattern extending along an opposing adjacent side of the insert layer. The individual pair members may be joined by a splice connector or extended length electrical connector thereby forming a complete circuit with a control element.

According to another aspect, it is contemplated that a complementary pair of heater and/or sensor wires may be arranged with a first pair member extending back and forth in a switchback pattern extending across at least a portion of an insert layer in transverse orientation to lateral edges of the insert layer and in further transverse orientation to a second pair member in the form of an elongate conductor extending at least partially along the length of the insert layer. The individual pair members may be joined by a splice connector or extended length electrical connector thereby forming a complete circuit with a control element.

According to still another aspect, it is contemplated that any desired patterned arrangement of complementary wire pairs may be repeated multiple times across the width of the insert layer thereby providing independently controllable heating zones at different positions across the blanket.

BRIEF DESCRIPTION OF THE DRAWINGS

The present invention will now be described by way of example only, with reference to the accompanying drawings which constitute a part of the specification herein and in which:

FIG. 8 illustrates an alternative electrical connection practice for complementary pairs of heater and/or sensor wires;

FIG. 9 is a cut-away view of a wrapped wire construction for use as a heating or sensing element using a wire wrapped around a fiber core; and FIG. 10 is a cut-away view of a wrapped wire construction for use as a heating or sensing element using pair of wires wrapped around a fiber core; and

DETAILED DESCRIPTION

Figure 1:
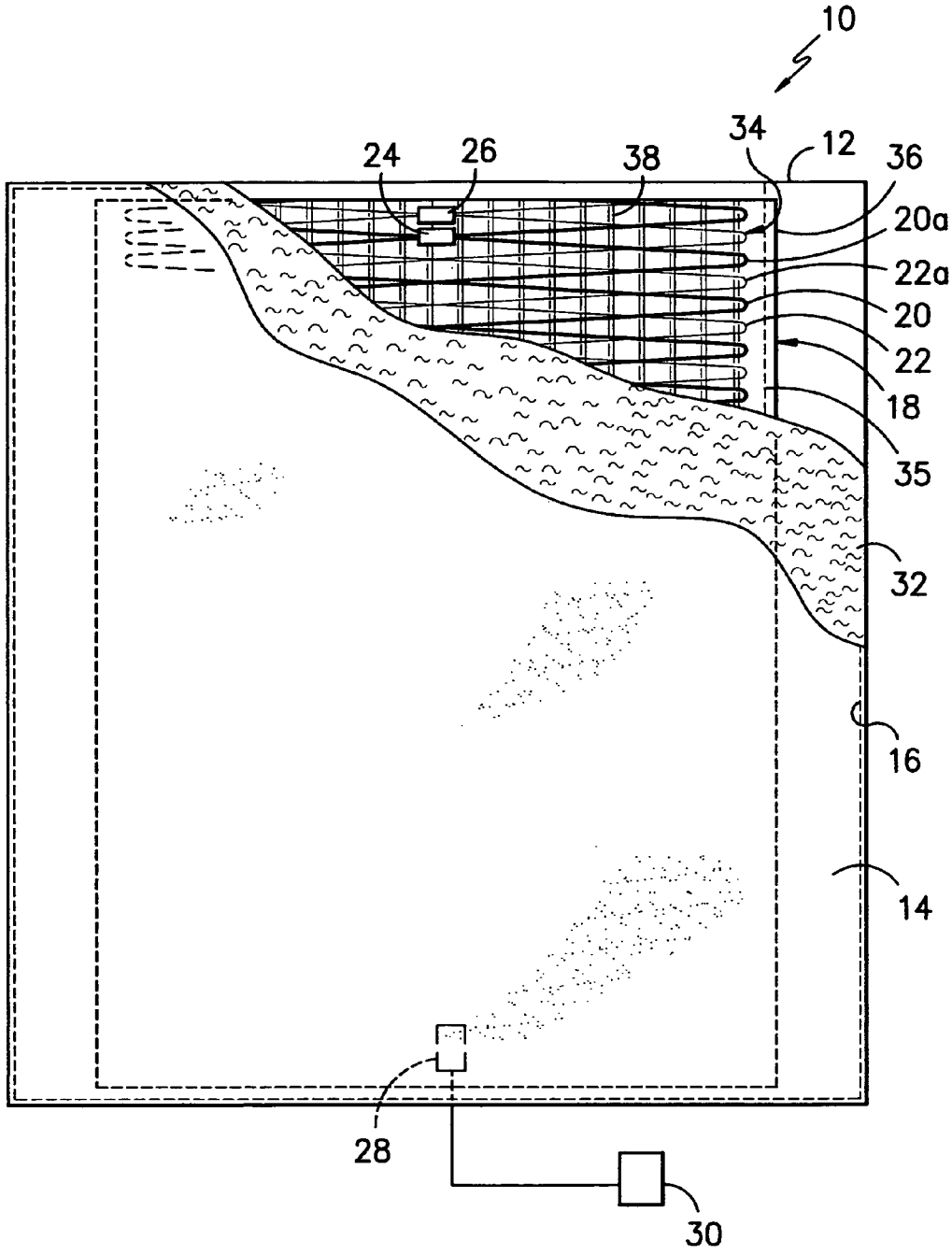
FIG. 1 is a partially cut-away view illustrating the components of an exemplary heating blanket in accordance with one embodiment of the present invention.

Reference will now be made to the drawings, wherein to the extent possible like elements are designated by like reference numerals throughout the various views. In FIG. 1, a cut-away view of an exemplary warming blanket 10 is shown. In the illustrated construction, the warming blanket 10 includes a first face structure 12 such as one or more layers of knit, woven, or nonwoven textile fabric or other suitable material. As will be appreciated, the outer surface of the first face structure 12 defines a first exterior face of the blanket 10. The blanket 10 further includes a second face structure 14 arranged in an opposing juxtaposed relation to the first face structure12. The outer surface of the second face structure 14 thus defines a second exterior face of the blanket 10. The second face structure 14 may be formed of any suitable material including one or more layers of woven, knit, or nonwoven textile or the like. The materials forming the first face structure 12 and the second face structure 14 may be similar or dissimilar depending upon desired blanket characteristics. As illustrated, the first face structure 12 and the second face structure 14 may be adjoined along their perimeter edges by a seam 16 such as a sewn seam, adhesive seam, welded seam, or the like so as to form an enclosed pocket for acceptance and housing of a scrim insert layer 18 and any other layers as may be desired. In the illustrated embodiment, an insulating layer 32 such as high loft polyester batting material or the like may be disposed between the scrim layer 18 and at least one of the face structures 12, 14. Of course, additional layers may also be incorporated if desired.

Figure 2:
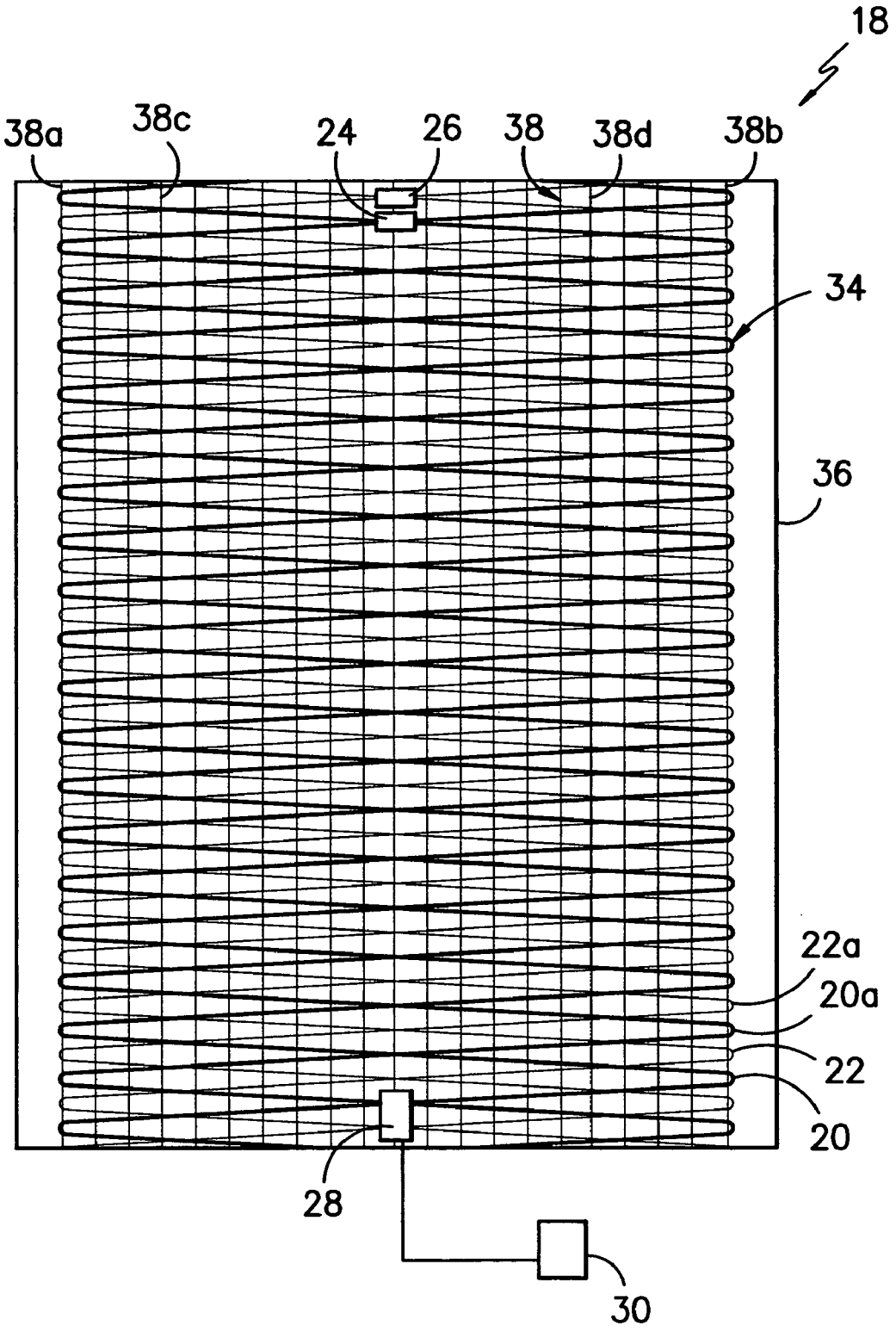
FIG. 2 is a view illustrating an exemplary tri-directional patterned arrangement for a pair of heating wires and a pair of sensor wires within a scrim insert sheet for disposition at the interior of the blanket of FIG. 1.
Figure 2A:
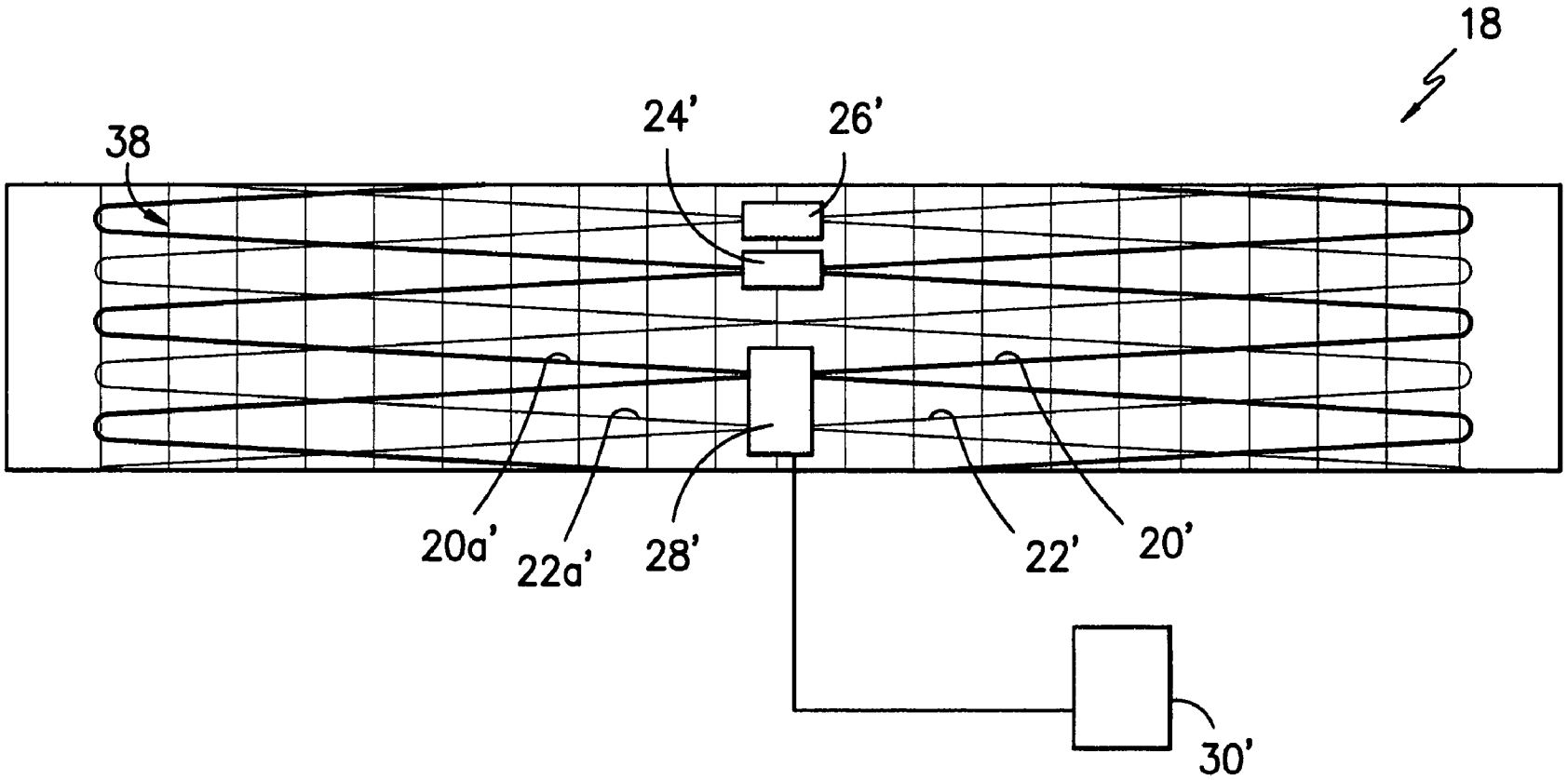
FIG. 2A is an enlarged view of a portion of the patterned arrangement in FIG. 2 illustrating an exemplary formation of circuit loops by adaptable placement of connections along the length of the scrim insert sheet.

As will be described more fully hereinafter, the scrim insert layer 18 incorporates one or more pairs of elongate heating wire elements 20, 20*a*, and/or one or more pairs of elongate sensor wire elements 22, 22*a*. That is, the scrim insert layer preferably includes at least two complementary circuit forming heating wire elements 20, 20*a*, and/or at least two complementary circuit forming sensor wire elements 22 and 22*a*. The wire elements 20, 20*a*, and 22, 22*a*, are preferably arranged in a predefined switchback pattern running back and forth in unbroken relation transverse to lateral sides of the scrim insert layer 18. As illustrated, complementary heating wire elements 20, 20*a*, may be connected together at a heating wire junction 24. Likewise, complementary sensor wire elements 22, 22*a*, may be joined together at a sensor wire junction 26 within the scrim insert layer 18. Such junctions may be established by cutting the individual wires and electrically connecting them together by standard techniques. As best illustrated in FIGS. 2 and 2A, the junctions 24, 26 may be used to establish closed circuits with a control element 28 operatively connected to a user setting device 30. As will be readily appreciated, although the control element 28 is illustrated as being housed within the scrim insert layer 18, it is likewise contemplated that the control element 28 may be housed within the user setting device 30 or at any other external location as may be desired so long as an operative connection with the wire elements is maintained.

As indicated, the scrim insert layer 18 preferably utilizes a pattern of heating wire elements 20, 20*a*, and sensor wire elements 22, 22*a*, running in switchback patterns along pathways transverse to lateral sides of the scrim insert layer 18. As will be appreciated, by the term "switchback pattern" is meant any pattern in which a wire element advances along a path oriented transverse to lateral edges of the scrim insert layer and where the wire moves back and forth between predetermined boundary positions.

In actual practice, it is contemplated that the scrim insert layer 18 may be susceptible to a number of different constructions. By way of example only, and not limitation, in FIGS. 1 and 2, a construction for the scrim insert layer 18 is illustrated wherein the heating wire elements 20, 20*a*, and the sensor wire elements 22, 22*a*, are each arranged in a pattern extending in angled relation to lateral edges of a scrim structure 34, thus forming a scrim with a tri-directional pattern. The scrim structure 34 is, in turn, optionally bonded to a stabilizing mat 36 such as a lightweight nonwoven textile or the like to promote ease of manipulation. As shown, the outboard edges of the stabilizing mat 36 preferably extend past the lateral boundary of the scrim structure 34. Thus, a seam 35 such as a woven seam, welded seam adhesive seam or the like may be used to hold the scrim insert layer in place without damaging the wire elements.

In practice, the scrim structure 34 at the interior of the stabilizing mat 36 may be formed by techniques such as weft insertion or the like as will be well known to those of skill in the art of textile manufacture. By using such a technique, the wire elements may be placed in transverse orientation to a collection of warp yarn elements 38 such as relatively large denier multifilament or monofilament polymeric yarns or the like. While the warp yarn elements 38 are illustrated as being arranged in a geometry with substantially equal spacing between each of the yarns, it is likewise contemplated that the warp yarn elements may be clustered in pairs or groups across the scrim structure 34 so as to provide desired stability characteristics. By way of example only, and not limitation, scrim formation techniques and resultant patterns are disclosed in U.S. Pat. No. 4,242,779 to Curinier et al. the teachings of which are hereby incorporated by reference. Of course, other practices and equipment as will be known to those of skill in the art may likewise be utilized if desired.

In one embodiment of the scrim structure 34 using the equipment, techniques, and resulting patterns of the Curiner et al. patent, the warp yarns 38 include a first selvage yarn 38*a* and a second selvage yarn 38*b*. The warp yarns 38 can also include top warp yarns 38*c*, and bottom warp yarns 38*d*. The first selvage yarn 38*a* and the second selvage yarn 38*b* are disposed at opposite lateral sides of the scrim structure 34. Because the heating wire elements 20, 20*a*, and the sensing wire elements 22, 22*a*, are wrapped around the first selvage yarn 38*a* and the second selvage yarn 38*b* to form the scrim structure 34, the result will be that the heating wire elements 20, 20*a*, and the sensing elements 22, 22*a*, each pass alternatively over and under the first selvage yarn 38*a*, and also pass alternatively over and under the second selvage yarn 38*b*. The top warp yarns 38*c* and the bottom warp yarns 38*d* are placed on opposite sides of the scrim structure 34 after the heating elements 20, 20*a*, and the sensing elements 22, 22*a*, are placed on the first selvage yarn 38*a* and the second selvage yarn 38*b*, and therefore remain on one side or the other of the scrim structure 34 for the entire length. It is also contemplated that multiple yarns that are in close or near proximate relationship can be used in the location of each first selvage yarn 38*a*, second selvage yarn 38*b*, top warp yarns 38*c*, and/or bottom selvage yarns 38*d*.

It is contemplated that the heating element wires 20, 20*a*, the sensor wires 22, 22*a*, and the warp yarns 38 may be bonded in place to the warp yarn elements 38 by application of a suitable adhesive coating. Such adhesive may also be used for application of any desired stabilizing mat 36 as may be utilized. By way of example only and not limitation, one contemplated adhesive that may be used is a PVC adhesive that remains substantially pliable upon curing. Of course, other adhesive systems that provide bonding stability while remaining pliable may likewise be used if desired.

As shown, by running the heating wire elements 20, 20*a*, and the sensor wire elements 22, 22*a*, in transverse angled relation to the warp yarns 38 and the lateral sides of the scrim structure 34, a tri-directional pattern of generally diamond-shaped zones is established along the length of the scrim structure 34 with the wire elements crossing their counterparts near the center. In the arrangement illustrated in FIGS. 1 and 2, the recurring crossing arrangement of complementary wire elements may be used in the formation of control circuits within the scrim structure 34 by making connections between pair members in the vicinity of the crossing points. Due to the regular occurrence of crossing points, scrim structures can thus be cut to virtually any length and a feedback loop can then be established back to a control element by simply joining complementary pair members at a position within the segmented region. Thus, the self-reversing side to side arrangement of heating wire elements and sensor wire elements yields a highly adaptable structure for use in a heating blanket. As illustrated in FIG. 2, the wire junctions 24, 26, are preferably located at a remote end of the scrim structure 34 relative to a control element 28. This permits the formed feedback circuit to cover a maximum area within the warming blanket 10, thereby providing control based on characteristics existing within the blanket as a whole.

In order to more clearly illustrate circuit formation within the scrim structure 34, FIG. 2A illustrates a shorter version of the scrim structure of FIG. 2 wherein a heating wire junction 24' and a sensor wire junction 26' have been placed in close proximity to a control element 28'. As can be seen in this view, a pair of complementary heating wire elements 20', 20*a*', extends away from the control element 28' to assume a patterned arrangement progressing upwardly along the scrim structure. The heating wire elements 20', 20*a*', cross one another at a position removed from the control element 28'. At this point of crossing, the heating wire elements 20', 20*a*', may be conveniently joined by a heating wire junction 24'. Thus, a closed feedback loop may be conveniently established. Likewise, a pair of complementary sensor wire elements 22', 22*a*', also extend from the control element 28', and crosses at a remote position removed from the control element 28'. Accordingly, by joining the sensor wire elements 22', 22*a*', at a sensor wire junction 26', a closed sensor loop is established. By segmenting the scrim structure outside the boundaries of heating wire junction 24 and sensor wire junction 26', the closed circuits established are not damaged. Moreover, virtually any length may be selected. Of course, it is to be understood that multiple pairs of heating and/or sensor wire elements may be utilized if desired. As will be appreciated, by using two or more pairs of heating and/or sensor wire elements, multiple parallel circuits may be established for monitoring and control of the warming blanket.

Figure 3:
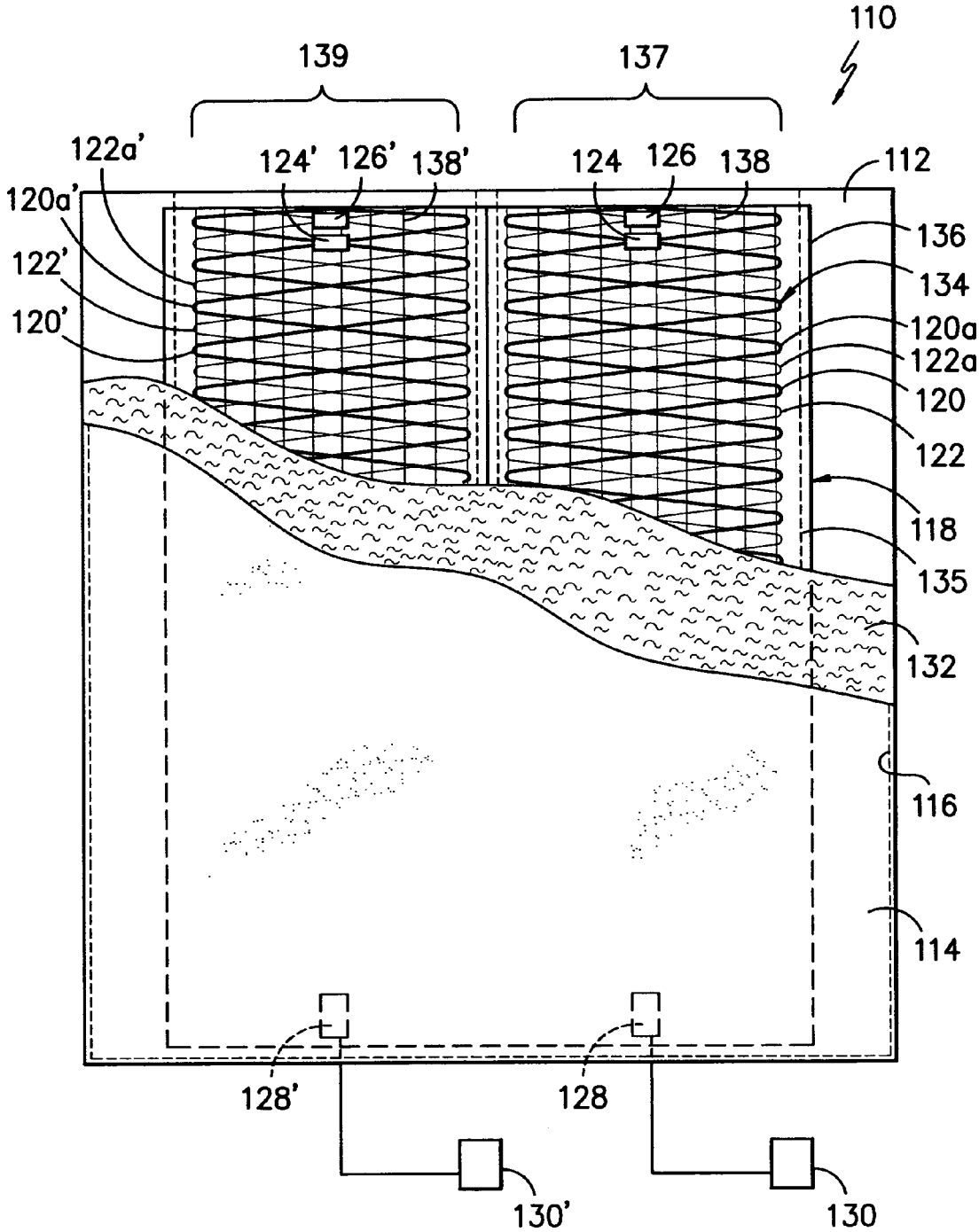
FIG. 3 is a partially cut-away view illustrating the components of an exemplary heating blanket in accordance with another embodiment of the present invention having a pair of adjacent heating zones.
Figure 4:
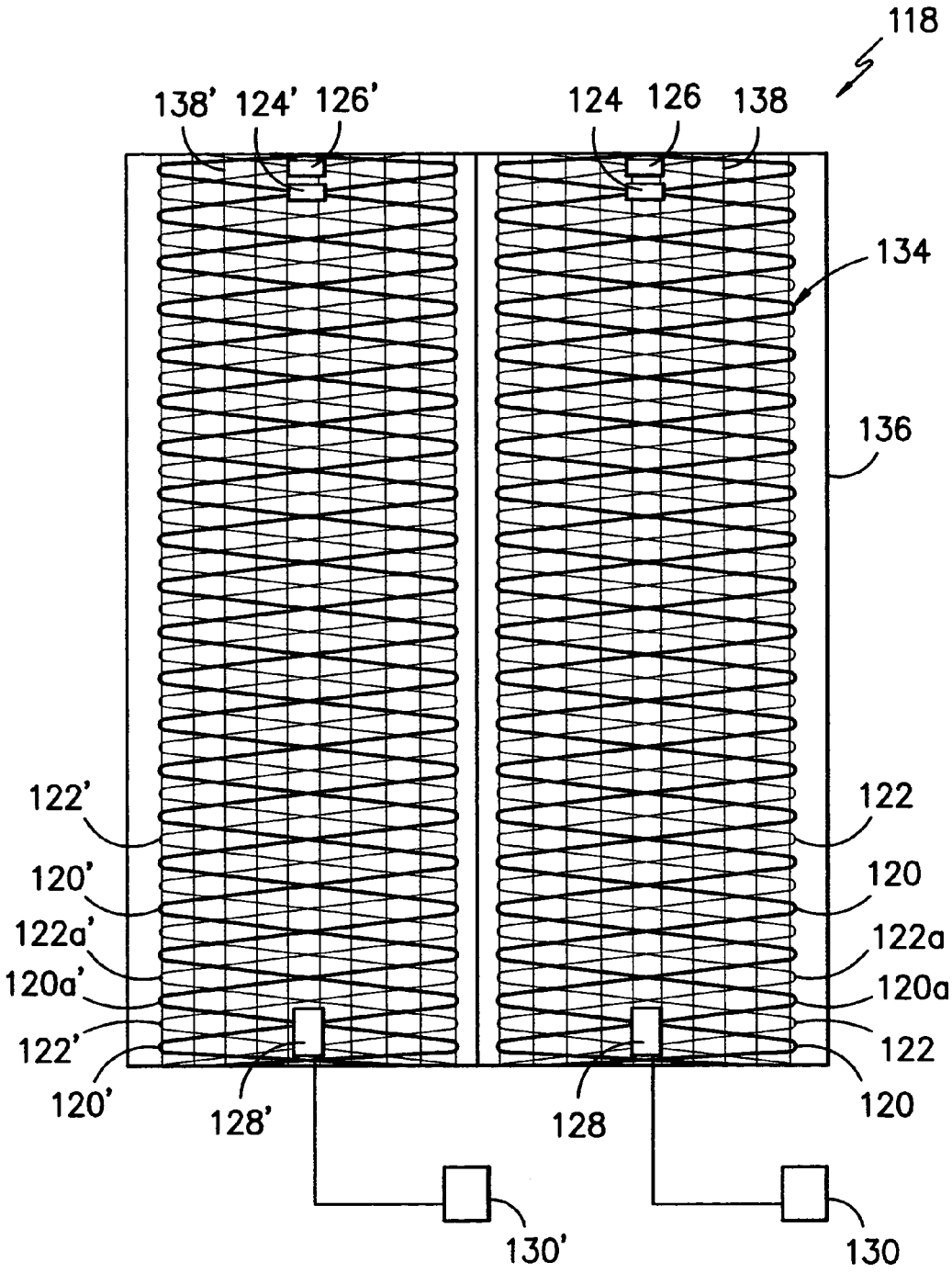
FIG. 4 is a view illustrating an exemplary patterned arrangement for two pairs of heating wires and complementary sensor wires arranged to provide a pair of adjacent controlled heating zones within a scrim insert sheet for disposition at the interior of the blanket of FIG. 3.

As indicated previously, it is also contemplated that two or more pairs of heating and or sensor wires may be arranged in patterns running across separate portions of an insert layer to establish two or more different heating zones across the width of the blanket. By way of example only, and not limitation, one such arrangement is illustrated in FIGS. 3 and 4. As will be appreciated, in these figures elements corresponding to those previously described are designated by like reference numerals within a 100 series.

In the illustrated exemplary blanket 110, a first pair of heating wire elements 120, 120*a* and a first pair of sensor wire elements 122, 122*a*, extends away from a control element 128 for operative connection at a heating wire junction 124 and at a sensor wire junction 126. As shown, the heating wire elements 120, 120*a*, and the sensor wire elements 122, 122*a*, run back and forth along paths transverse to the lateral boundary of the scrim insert layer 118. However, in the illustrated embodiment, the wire elements are patterned across a first discrete width segment extending from adjacent a first edge of the insert layer 118 to an intermediate position at the interior of the insert layer. This discrete width segment thus defines a first heating zone 137 across the width of the blanket 110. As illustrated, a second pair of heating wire elements 120', 120*a*', and a second pair of sensor wire elements 122', 122*a*', extends away from a control element 128' for operative connection at a heating wire junction 124' and at a sensor wire junction 126'. As shown, the heating wire elements 120', 120*a*', and the sensor wire elements 122', 122*a*', run back and forth along paths transverse to the lateral boundary of the scrim insert layer 118. In the illustrated embodiment, the wire elements 120' 120*a*', and 122', 122*a*', are patterned across a second discrete width segment extending from adjacent a second edge of the insert layer 118 to an intermediate position at the interior of the insert layer. This discrete width segment thus defines a second heating zone 139 across the width of the blanket 110.

Of course, it is contemplated that any number of discrete width heating zones may be used across the blanket 110 as may be desired.

On potential benefit for the use of two or more discrete width heating zones is the ability to separately control temperature at different segments of the blanket. Thus, in the illustrated arrangement each heating zone is operatively connected to an independent control unit and user setting device. However, it is likewise contemplated that two or more heating zones may be connected to a common control unit to provide a substantially uniform temperature across the entire blanket. Such an arrangement may be desirable in a blanket of substantial width.

Figure 5:
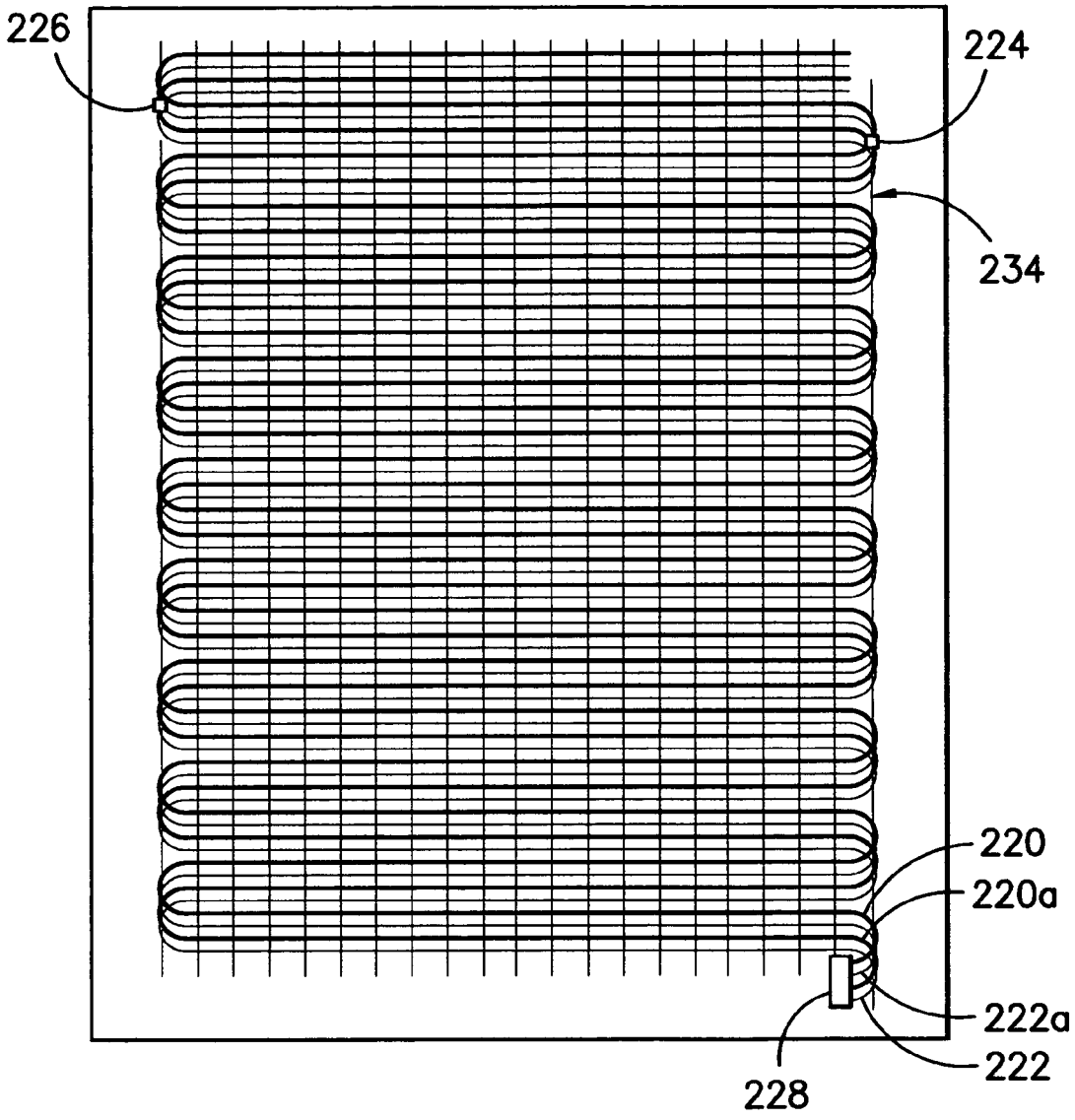
FIG. 5 is an exemplary bi-directional pattern for a pair of heating wires and a pair of sensor wires within a scrim insert sheet for disposition at the interior of a heating blanket.

By way of example only, and not limitation, FIG. 5 illustrates an alternative patterning arrangement wherein elements corresponding to those previously described are designated by like reference numerals within a 200 series. As illustrated, in this arrangement, the elongate heating wire elements 220, 220*a*, and sensor wire elements 222, 222*a*, run substantially parallel to one another across the scrim structure 234 such that they are substantially perpendicular to the lateral edges of the scrim structure 234. As will be appreciated, such patterns may be established by techniques as will be known to those of skill in the art of textile manufacture. By way of example only, and not limitation, such scrim formation techniques and resultant patterns are disclosed in U.S. Pat. No. 4,242,779 to Curinier et al. Of course, other practices and equipment as will be known to those of skill in the art may likewise be utilized if desired.

As illustrated, in the construction of FIG. 5, the individual heating wire elements 220, 220*a*, and sensor wire elements 222, 222*a*, cross over one another at the lateral boundary edges of the scrim structure 234. Thus, a heating wire junction 224 and a sensor wire junction 226 can be readily formed at the lateral edge cross-over points thereby establishing a heating wire feedback loop and a sensor wire feedback loop to a control element 228. In all other respects, such a construction will operate in the same manner as described in relation to the prior embodiments.

Figure 6:
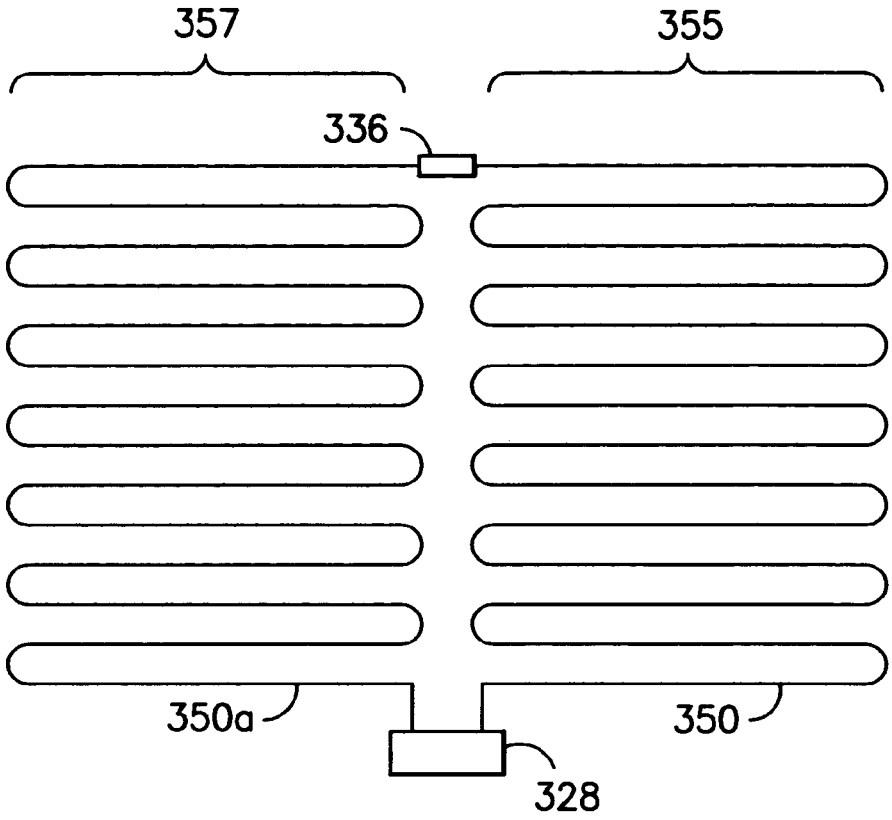
FIG. 6 is an exemplary pattern for a complementary pair of heater and/or sensor wires arranged in a side-by-side stacked pattern with a first pair member running back and forth in a pattern extending along one side of the insert layer and a second pair member running back and forth in a pattern extending along an opposing adjacent side of the insert layer.

Still another patterning arrangement for a cooperating pair of wires is illustrated in FIG. 6. In this arrangement, a complementary pair of heater and/or sensor wires 350, 350*a*, may be arranged in a side-by-side stacked pattern. In such an arrangement a first pair member 350 extends away from a control element 328 back and forth in a switchback pattern extending across a first discrete width zone 355. The second pair member 350*a* extends away from the control element 328 back and forth in a switchback pattern extending across a second discrete width zone 357. At a desired position along the length of the pattern, complementary pair members may be operatively connected at a junction 336 so as to close the circuit with the control element 328. Of course, a second pair of wire elements may also be incorporated so that both heating and sensing functions are provided. Moreover, while a substantially bi-directional wire pattern is illustrated, it is likewise contemplated that a tri-directional pattern may be used in such an arrangement if desired.

Figure 7:
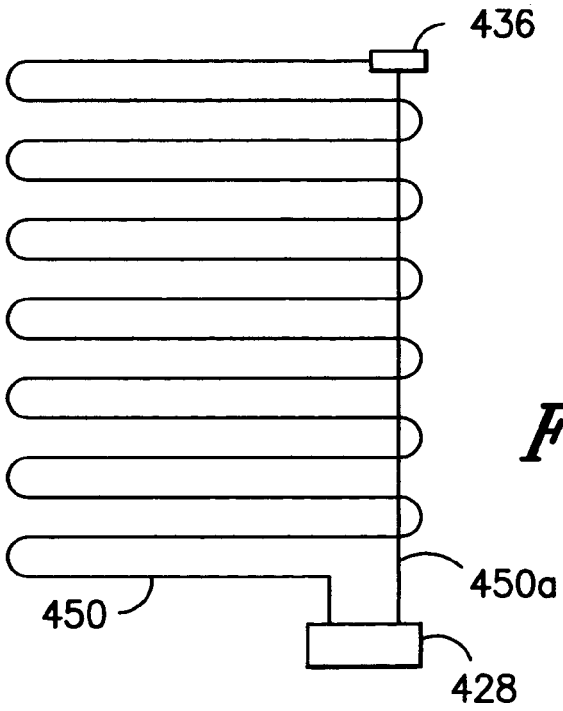
FIG. 7 is an exemplary pattern for a complementary pair of heater and/or sensor wires with a first pair member running back and forth in a pattern extending across at least a portion of an insert layer in transverse orientation to lateral edges of the insert layer and in further transverse orientation to a second pair member such as a warp or selvage element in the form of an elongate conductor extending at least partially along the length of the insert layer.

Another patterning arrangement for a cooperating pair of wires is illustrated in FIG. 7. In this arrangement a complementary pair of heater and/or sensor wires extend away from a control element 428 to define a feedback circuit. A first pair member 450 extends back and forth in a switchback pattern extending across at least a portion of an insert layer in transverse orientation to lateral edges of the insert layer. Moreover, the first pair member 450 runs in a pattern substantially transverse to a second pair member 450*a* in the form of an elongate conductor extending at least partially along the length of the pattern. If desired, the second pair member 450*a* may be a selvage or warp yarn within the insert layer. The individual pair members 450 and 450*a* may be joined by a splice connector 436 or extended length electrical connector thereby forming a complete circuit with the control element. Of course, a second pair of wire elements may also be incorporated so that both heating and sensing functions are provided. Moreover, while a substantially bi-directional wire pattern is illustrated, it is likewise contemplated that a tri-directional pattern may be used in such an arrangement if desired.

Yet another patterning arrangement for a cooperating pair of wires is illustrated in FIG. 8. In this arrangement a complementary pair of heater wires 520, 520*a*, and a complementary pair of sensor wires 522, 522*a*, extend away from a control element 528 in a tri-directional scrim arrangement as illustrated and described in relation to FIGS. 1–4. However, in the arrangement of FIG. 8, the complementary pair members are operatively connected by elongate conducting elements 570, 572 extending between a pair of heating wire junctions 524 and sensor wire junctions 526. As will be appreciated, such an arrangement avoids the need to connect wire elements at crossing points within the pattern.

Of course, it is to be understood that any of the patterning arrangements may be used at multiple discrete zones across the with of the blanket if desired. Likewise, combinations of such patterns may be used at different zones if desired.

Although the heating and sensor wire elements perform different functions, it is contemplated that they may be of substantially similar construction. By way of example only, and not limitation, exemplary constructions for such elongate elements are illustrated in FIGS. 9 and 10. In the construction illustrated in FIG. 9, a single conductive metallic wire 40 extends in wrapped relation around a flexible core 42, such as a polymeric fiber or the like. The metallic wire 40 may be formed of any suitable material including copper, copper alloys, and other ferrous and nonferrous metals including nickel, steel, and the like. According to one contemplated practice, the metallic wire 40 may be a copper alloy wire such as is available from Fisk Alloy having a thickness of about 33 to about 42 American wire gauge (awg). The metallic wire 40 may be wrapped around a PET textile core having a linear density of about 500 to about 1000 denier. An insulating layer 44 such as PVC or the like extends in surrounding relation to the wrapped structure. It has been found that elongate structures of such construction exhibit substantial flexibility without undue levels of strain hardening so as to permit their insertion in a scrim structure without undue strain hardening and embrittlement. If desired, the metallic wire 40 may also include a nonconductive coating such as enamel or the like. However, metallic wires without such coating may also be utilized if desired.

In the construction illustrated in FIG. 10, a pair of conductive metallic wires 40', 41' formed of metallic materials such as those previously described extends in wrapped relation around a flexible core 42' such as a polymeric fiber or the like. In all other respects, the structure is identical to that of FIG. 9. As will be appreciated, in the event that double wrapped wire construction is utilized, the individual wire elements may be electrically connected at one end to form a desired wire pair circuit. This may permit junctions to be formed at substantially any position within the scrim structure rather than at the crossing points of discrete wires. If desired, A double wrapped wire construction may also be connected to another double wrapped crossing wire, such that a pair or circuits is established. Thus, a pair of feedback loops may be established without increasing the number of elongate wire pairs.

Referring to the embodiment of FIG. 1, according to one contemplated and potentially preferred practice, during operation of the blanket, the user will connect the system to a power source and select a desired user setting at the user setting device 30. A signal is then sent from the user setting device 30 to the control element 28 for delivery of current though one or more heating wire elements 20, 20*a*. In conjunction with activation of the system, a sensing current is also delivered from the control element 28 to the sensor wire elements 22, 22*a*. During application of the sensing current, a voltage sensor measures the voltage across the sensor wire elements 22, 22*a*. Based on the known sensing current output and the measured voltage across the sensor wire elements, the control element 28 calculates the temperature of the sensor wire elements 22, 22*a*, based on either a transfer function programmed into the control element or data stored in a look-up table. Based on the measured temperature of the sensor wire, the control element 28 then adjusts the current flow to the heating wire elements 20, 20*a*, as necessary to achieve the selected user setting. This process is performed continuously to achieve and maintain a desired steady state temperature.

Of course, in separate heating zone embodiments such as illustrated in FIGS. 3 and 4, separate user setting devices 130, 130', may be used to control the temperature in different portions of the blanket. However, in all other respects, the operation is substantially the same.

Although the heating and sensor wire elements perform different functions, it is contemplated that they may be of substantially similar construction. By way of example only, and not limitation, exemplary constructions for such elongate elements are illustrated in FIGS. 9 and 10. In the construction illustrated in FIG. 9, a single conductive metallic wire 40 extends in wrapped relation around a flexible core 42, such as a polymeric fiber or the like. The metallic wire 40 may be formed of any suitable material including copper, copper alloys, and other ferrous and nonferrous metals including nickel, steel, and the like. According to one contemplated practice, the metallic wire 40 may be a copper alloy wire such as is available from Fisk Alloy having a thickness of about 33 to about 42 American wire gauge (awg). The metallic wire 40 may be wrapped around a PET textile core having a linear density of about 500 to about 1000 denier. An insulating jacket 44 such as PVC or the like extends in surrounding relation to the wrapped structure. It has been found that elongate structures of such construction exhibit substantial flexibility without undue levels of strain hardening so as to permit their insertion in a scrim structure without undue strain hardening and embrittlement. If desired, the metallic wire 40 may also include a nonconductive coating such as enamel or the like. However, metallic wires without such coating may also be utilized if desired.

In the construction illustrated in FIG. 10, a pair of conductive metallic wires 40', 41' formed of metallic materials such as those previously described extends in wrapped relation around a flexible core 42' such as a polymeric fiber or the like. In all other respects, the structure is identical to that of FIG. 9. As will be appreciated, in the event that double wrapped wire construction is utilized, the individual wire elements may be joined together to form a desired feedback circuit. This may permit junctions to be formed at substantially any position within the scrim structure rather than at the crossing points of discrete wires. If desired, A double wrapped wire construction may also be connected to another double wrapped crossing wire, such that a pair or circuits is established. Thus, a pair of feedback loops may be established without increasing the number of elongate wire pairs.

Referring to the embodiment of FIG. 1, according to one contemplated and potentially preferred practice, during operation of the blanket, the user will connect the system to a power source and select a desired user setting at the user setting device 30. A signal is then sent from the user setting device 30 to the control element 28 for delivery of current though one or more heating wire elements 20. In conjunction with activation of the system, a sensing current is also delivered from the control element 28 to the sensor wire elements 22. During application of the sensing current, a voltage sensor measures the voltage across the sensor wire elements 22. Based on the known sensing current output and the measured voltage across the sensor wire elements, the control element 28 calculates the temperature of the sensor wire elements 22 based on either a transfer function programmed into the control element or data stored in a look-up table. Based on the measured temperature of the sensor wire, the control element 28 then adjusts the current flow to the heating wire elements 20 as necessary to achieve the selected user setting. This process is performed continuously to achieve and maintain a desired steady state temperature.

Of course, in separate heating zone embodiments such as illustrated in FIGS. 3 and 4, separate user setting devices 130, 130' may be used to control the temperature in different portions of the blanket. However, in all other respects, the operation is substantially the same.

While the present invention has been illustrated and described in relation to certain potentially preferred embodiments and practices, it is to be understood that the illustrated and described embodiments and practices are illustrative only and that the present invention is in no event to be limited thereto. Rather, it is fully contemplated that modifications and variations to the present invention will no doubt occur to those of skill in the art upon reading the above description and/or through practice of the invention. It is therefore intended that the present invention shall extend to all such modifications and variations as may incorporate the broad aspects of the present invention within the full spirit and scope of the invention.

What is claimed is:

1. A controlled temperature warming blanket, the warming blanket comprising a shell structure and a scrim insert layer disposed at the interior of the shell structure, wherein the scrim insert layer comprises a first elongate conductive wire structure operatively connected to a control element and at least a second elongate conductive wire structure operatively connected to the control element, wherein at least one of said elongate conductive wire structures is disposed in a switchback patterned arrangement within the scrim insert layer such that the first and second elongate conductive wire structures cross at defined positions along the length of the insert layer, said first and second elongate conductive wire structures being operatively connected within the insert layer remote from the control element such that a circuit is completed with the control element.

2. The invention as recited in claim 1, wherein said first and second elongate conductive wire structures are heating wires adapted to selectively raise the temperature within the scrim insert layer.

3. The invention as recited in claim 2, wherein said first and second elongate conductive wire structures comprise metallic wire disposed in wrapped relation to a textile fiber core with an insulating sleeve disposed in surrounding relation to the wrapped wire and fiber core.

4. The invention as recited in claim 2, wherein said first and second elongate conductive wire structures comprise a pair of metallic wires disposed in wrapped relation to a textile fiber core with an insulating sleeve disposed in surrounding relation to the wrapped wire and fiber core.

5. The invention as recited in claim 1, wherein said first and second elongate conductive wire structures are sensor wires adapted to monitor temperature within the scrim insert layer.

6. The invention as recited in claim 5, wherein said first and second elongate conductive wire structures comprise metallic wire disposed in wrapped relation to a textile fiber core with an insulating sleeve disposed in surrounding relation to the wrapped wire and fiber core.

7. The invention as recited in claim 5, wherein said first and second elongate conductive wire structures comprise a pair of metallic wires disposed in wrapped relation to a textile fiber core with an insulating sleeve disposed in surrounding relation to the wrapped wire and fiber core.

8. The invention as recited in claim 1, wherein said first and second elongate conductive wire structures are disposed in a substantially continuous switchback pattern in transverse orientation to a plurality of stabilizing warp yarn elements.

9. The invention as recited in claim 8, wherein said first and second elongate conductive wire structures are disposed in non-perpendicular angled orientation to lateral edges of the insert layer.

10. The invention as recited in claim 8, wherein portions of said first and second elongate conductive wire structures are disposed along pathways in substantially perpendicular orientation to lateral edges of the insert layer such that portions of said first and second elongate conductive wire structures are substantially parallel to one another at the interior of the insert layer.

11. The invention as recited in claim 8, wherein the first and second elongate conductive wire structures are adhesively bonded to said stabilizing warp yarn elements.

12. The invention as recited in claim 1, further comprising at least one insulating layer disposed within the shell structure.

13. A controlled temperature warming blanket, the warming blanket comprising a shell structure and a scrim insert layer disposed at the interior of the shell structure, wherein the scrim insert layer comprises a first elongate conductive heating wire structure operatively connected to a control element, at least a second elongate conductive heating wire structure operatively connected to the control element, a first elongate conductive sensor wire structure operatively connected to the control element and at least a second elongate conductive sensor wire structure operatively connected to the control element, wherein said elongate conductive wire structures are disposed in a switchback patterned arrangement within the scrim insert layer such that the first and second elongate conductive heating wire structures cross at defined positions along the length of the insert layer, and the first and second elongate conductive sensor wire structures cross at defined positions along the length of the insert layer, said first and second elongate conductive heating wire structures being operatively connected within the insert layer remote from the control element such that a heating circuit is completed with the control element and said first and second elongate conductive sensor wire structures being operatively connected within the insert layer remote from the control element such that a sensing circuit is completed with the control element.

14. The invention as recited in claim 13, wherein said first and second elongate conductive heating wire structures each comprise metallic wire disposed in wrapped relation to a textile fiber core with an insulating sleeve disposed in surrounding relation to the wrapped wire and fiber core.

15. The invention as recited in claim 13, wherein said first and second elongate conductive heating wire structures each comprise a pair of metallic wires disposed in wrapped relation to a textile fiber core with an insulating sleeve disposed in surrounding relation to the wrapped wire and fiber core.

16. The invention as recited in claim 13, wherein said first and second elongate conductive sensor wire structures each comprise metallic wire disposed in wrapped relation to a textile fiber core with an insulating sleeve disposed in surrounding relation to the wrapped wire and fiber core.

17. The invention as recited in claim 13, wherein said first and second elongate conductive sensor wire structures each comprise a pair of metallic wires disposed in wrapped relation to a textile fiber core with an insulating sleeve disposed in surrounding relation to the wrapped wire and fiber core.

18. The invention as recited in claim 13, wherein said first and second elongate conductive heating wire structures and said first and second elongate conductive sensor wire structures are disposed in non-perpendicular angled orientation to lateral edges of the insert layer.

19. The invention as recited in claim 13, wherein portions of said first and second elongate conductive heating wire structures and portions of said first and second elongate conductive sensor wire structures are disposed along pathways in substantially perpendicular orientation to lateral edges of the insert layer such that portions of said first and second elongate conductive heating wire structures and portions of said first and second elongate conductive sensor wire structures are substantially parallel to one another at the interior of the insert layer.

* * * * *